US007822326B2

(12) United States Patent
Commette et al.

(10) Patent No.: US 7,822,326 B2
(45) Date of Patent: Oct. 26, 2010

(54) HYBRID HEATER

(75) Inventors: Denis S. Commette, Mantoloking, NJ (US); Jerome Priest, Toms River, NJ (US)

(73) Assignee: Graco Minnesota, Inc., Minneapolis, MN (US)

( * ) Notice: Subject to any disclaimer, the term of this patent is extended or adjusted under 35 U.S.C. 154(b) by 526 days.

(21) Appl. No.: 10/588,202

(22) PCT Filed: Feb. 1, 2005

(86) PCT No.: PCT/US2005/002892

§ 371 (c)(1),
(2), (4) Date: Apr. 19, 2007

(87) PCT Pub. No.: WO2005/078355

PCT Pub. Date: Aug. 25, 2005

(65) Prior Publication Data

US 2007/0274697 A1 Nov. 29, 2007

Related U.S. Application Data

(60) Provisional application No. 60/542,062, filed on Feb. 5, 2004.

(51) Int. Cl.
*F24H 1/10* (2006.01)

(52) U.S. Cl. ..... 392/484; 392/465; 392/490

(58) Field of Classification Search ..... 392/465, 392/484, 490

See application file for complete search history.

(56) References Cited

U.S. PATENT DOCUMENTS 1,744,598 A 1/1930 Wait
2,267,264 A 12/1941 Bland
2,775,683 A * 12/1956 Kleist ..... 392/398
2,802,089 A 8/1957 Beck
2,866,885 A 12/1958 McIlrath
3,389,538 A 6/1968 Carel
3,584,194 A 6/1971 Kautz et al.
3,898,428 A * 8/1975 Dye ..... 392/489
4,199,675 A 4/1980 Sharpless
4,334,141 A 6/1982 Roller et al.
4,343,988 A 8/1982 Roller et al.
4,369,351 A 1/1983 Massey et al.
4,465,922 A 8/1984 Kolibas (Continued)

FOREIGN PATENT DOCUMENTS

DE 201 08 117 U1 9/2001

(Continued)

*Primary Examiner*—Thor S Campbell
(74) *Attorney, Agent, or Firm*—Leydig, Voit & Mayer, Ltd.

(57) ABSTRACT

A hybrid heater that includes a structural mass into which passages are provided to create a labyrinth for chemical flow through the structural mass, the passages being sized and disposed to receive a plurality of heater rods such that the chemical is traversed through the passages in direct contact with the heater rods. A coiled spring may be disposed or other spiral arrangement provided in the space between and against the walls of the passages and the heater rod to facilitate flow uniformity around the rods. A temperature sensor may be provided in direct contact with the heating element and may be fitted with a mass sleeve to draw off any excess heat on the sensor during transitions.

22 Claims, 7 Drawing Sheets

U.S. PATENT DOCUMENTS

| | | | | |
|---|---|---|---|---|
| 4,501,952 | A | 2/1985 | Lehrke | |
| 5,265,318 | A | 11/1993 | Shero | |
| 5,325,822 | A * | 7/1994 | Fernandez | 392/491 |
| 5,694,515 | A | 12/1997 | Goswami et al. | |
| 5,724,478 | A * | 3/1998 | Thweatt | 392/484 |
| 5,872,890 | A * | 2/1999 | LaCombe | 392/487 |
| 5,949,958 | A | 9/1999 | Naperkowski et al. | |
| 6,330,395 | B1 * | 12/2001 | Wu | 392/494 |
| 6,389,226 | B1 * | 5/2002 | Neale et al. | 392/485 |
| 6,557,773 | B2 | 5/2003 | Stemmler et al. | |
| 6,944,394 | B2 * | 9/2005 | Long et al. | 392/485 |
| 7,046,922 | B1 * | 5/2006 | Sturm et al. | 392/482 |
| 7,088,915 | B1 * | 8/2006 | Sturm et al. | 392/466 |

FOREIGN PATENT DOCUMENTS

| | | | |
|---|---|---|---|
| ES | 1 048 832 | U | 10/2001 |
| GB | 2265445 | A | 9/1993 |

* cited by examiner

HYBRID HEATER

FIELD OF THE INVENTION

This invention pertains to dedicated heaters for preheating chemical in mixing heads or spray guns for use in chemical processing, and more particularly to a heating unit that combines the beneficial features of both mass and direct contact style heaters.

BACKGROUND OF THE INVENTION

In chemical processing, such as plural component polyurethane processing, the proper mixing of the chemical components is essential to developing the final physical properties specified by the system supplier. In impingement designed mixing heads or spray guns, lowering the viscosities with heat helps to facilitate proper mixing. The two types of preheaters are typically utilized in impingement designed mixing heads/spray guns.

The first style, mass style, heats by conduction. Mass style heating utilizes a structural block, which is typically aluminum, into which holes are bored or small grooves cut and hydraulically connected to form a labyrinth through which the chemical passes. Heater rods are attached to or embedded in the block to raise the temperature of the surrounding structural mass, which in turn raises the temperature of the chemical within the holes/grooves. In this type of heating, the heater rods are isolated from the grooves or holes through which the chemical flows. Thus, heat is transferred from the heated mass to the chemical, which is either in a static or dynamic state within the chemical grooves, by means of conduction. The temperature of the mass, and, indirectly, the chemical, is maintained at the process temperature by means of a temperature controller and a sensor located within the mass. Typical mass style heating arrangements are disclosed, for example, in U.S. Pat. No. 2,866,885 to McIlrath, and U.S. Pat. No. 4,343,988 to Roller et al.

Mass style heaters have numerous advantages and disadvantages. Mass style heaters exhibit high thermal inertia in that, once at temperature, they tend to resist small temperature changes. As a result, mass style heaters generally provide stable temperature control if the chemical is maintained in a constant dynamic state or a constant static state. During the transition from the dynamic mode to the static mode, however, the mass ends to retain its temperature and pass it off to the static chemical causing an undesirable temperature spike. Conversely, as the chemical transitions from the static mode to the dynamic, the inefficiency of the mass heater causes a temperature drop at the outlet of the heater. Thus, mass style heaters are typically slow in responding to flow changes. Moreover, inasmuch as the labyrinth of drilled holes typically comprises relatively small grooves, it can develop backpressure during dynamic conditions.

The second style is the direct contact style heater. Direct contact style heaters utilize direct heating by placing heater rods into direct contact with the chemical. A heater rod is paced into a hydraulic tube of a given diameter. One or more such hydraulic tubes are typically connected to a manifold interconnecting other similarly configured tubes with an inlet and an outlet. The chemical traverses through the tubes in direct contact with the heater rods. Examples of direct contact style heaters are shown, for example, in U.S. Pat. No. 4,465,922 to Kolibas.

As with the mass style heater, direct contact style heating has both its advantages and disadvantages. Because there is little thermal inertia, direct contact style heating responds well to flow changes. Additionally, such heaters come to temperature quickly, providing a very fast warm up cycle. Direct style heaters provide more efficient heat transfer than mass style heaters. Direct style heaters provide a much greater difference in temperature between the set point temperature and the fire rod surface temperature such that the temperature control is less stable in steady conditions than mass style heaters. Further, direct contact heaters have historically been more costly to manufacture and assemble than mass style heaters. Moreover, the physical dimensions of direct style heaters constrain the number of tubes, thus shortening the contact surface area available for heat transfer.

Accordingly, there exists a need for a heating arrangement that provides the advantages of the currently available heaters, while minimizing or eliminating the disadvantages of the same. The invention provides such an arrangement. The advantages of the invention, as well as additional inventive features, will be apparent from the description of the invention provided herein.

BRIEF SUMMARY OF THE INVENTION

The invention comprises a hybrid heater that combines aspects of both the mass style and direct contact style heaters. The hybrid heater includes a structural mass, similar to the mass style heater, into which passages are provided of a diameter similar to the inside diameter of the tubes of the direct contact style heater. A heater rod is placed in the passage, and the chemical is traversed through the passages such that it comes into direct contact with the heater rod within the passage, the passage being surrounded by the structural mass.

Thus, hybrid heater combines the advantages of both types of heaters while minimizing or eliminating the associated disadvantages of each. Among other things, the hybrid heater design provides very stable temperature control. As opposed to direct style heaters, the structural mass of the hybrid heater acts as a heat sink to draw off the excess temperature. The mass provides stability, and the controlled direct contact provides superior heat transfer. In the currently preferred embodiment, 30% greater heating surface area is provided within the same envelope as current mass style designs. The hybrid heater also provides more rapid warm up cycle and temperature control of the direct contact style heaters. The efficient heat transfer results in a delta T to flow rate not previously achieved in the prior art. Additionally, it is of a lower cost to manufacture than direct contact style heaters.

As another aspect of the design, a coiled spring may be disposed or other spiral arrangement provided in the space between and against the walls of the passages and the heater rod. This provides flow uniformity around the rod, defeating the random flow of chemical along the heating element, resulting in very efficient heat transfer and very low backpressure development during use.

Alternately or additionally, a temperature sensor may be provided in direct contact with the heating element, thus maintaining a relatively small delta T between the surface of the element and the process temperature. The temperature sensor may also be fitted with a mass sleeve, which draws off any excess heat on the sensor during transitions, resulting in very stable temperature control.

These and other advantages of the invention will be appreciated upon reading the brief description of the drawings and the detailed description of the invention, and upon review of the drawings.

DETAILED DESCRIPTION OF THE INVENTION

Figure 1:
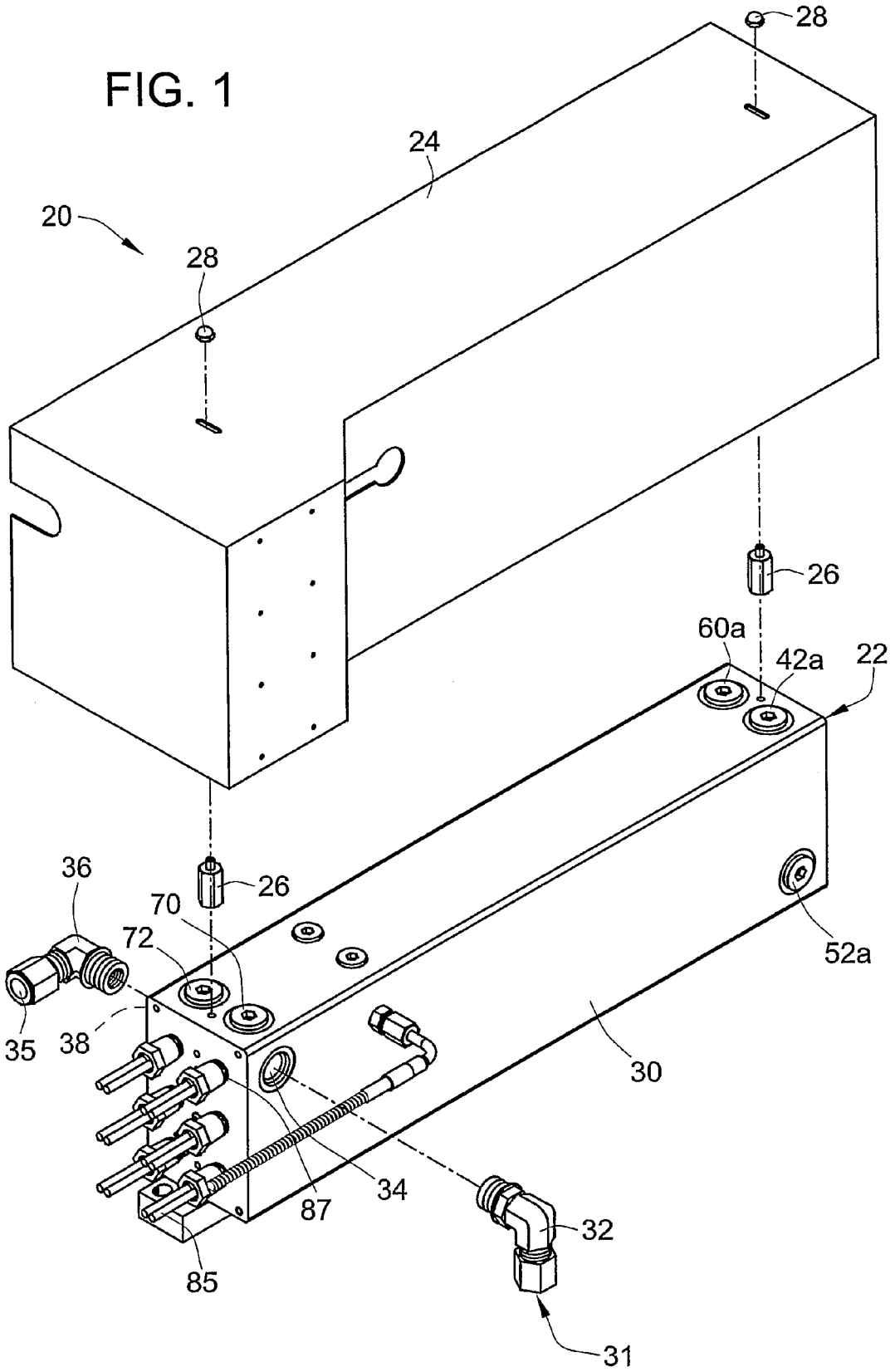
FIG. 1 is a partially exploded perspective view of a hybrid heater assembly constructed in accordance with teaching of the invention.

Turning now to the drawings, there is shown in FIG. 1, a preheater assembly 20 constructed in accordance with teachings of the invention. The preheater assembly 20 includes a preheater 22, which is covered by a preheater cover 24. In the embodiment shown, the preheater cover 24 is spaced apart from the preheater 22 by spacers or standoffs 26 and secured by acorn nuts 28, although any appropriate arrangement may be utilized. The preheater 22 comprises a structural mass or block 30 that is preferably formed of aluminum or the like. The structural mass 30 may be formed by any appropriate method, but is preferably machined from a block of aluminum.

Figure 3:
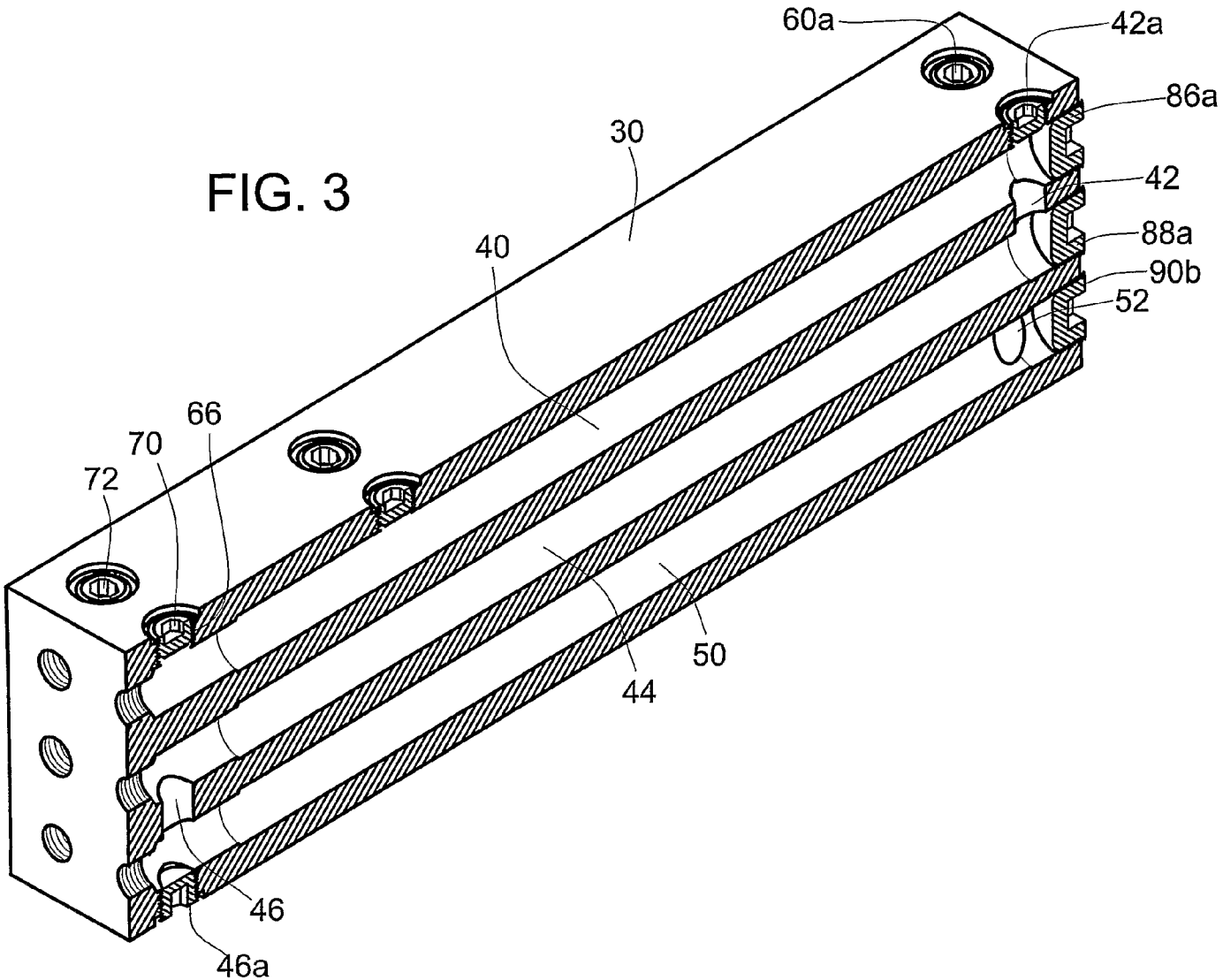
FIG. 3 is a cross-sectional view of the structural mass taken along line 3-3 in FIG. 2.

In order to provide a flow of material to be heated, the preheater 22 is provided with an inlet 35 in the form of an inlet fitting 36 disposed in an inlet bore 38 in the mass 30, and an outlet 31 in the form of an outlet fitting 32 disposed in an outlet bore 34 in the mass 30. Internally, the mass 30 is provided with a series of parallel and perpendicular bores that provide an elongated path for the flow of material through the mass 30. As may be seen in the cross-sectional drawing of FIG. 3 and the schematic rendition of FIG. 5, material entering the structural mass 30 through the inlet bore 38 enters elongated bore 62. The material flows down elongated bore 62 to its opposite end where it flows perpendicularly through vertical bore 60 to cross over to elongated bore 58. After flowing down elongated bore 58, the material again flows perpendicularly, vertically through bore 56 into elongated bore 54. The material flows through elongated bore 54, and, at the opposite end, flows perpendicularly through cross bore 52 and into elongated bore 50 (as may be seen in FIG. 4). In a similar manner, the material flows through elongated bore 50, then perpendicularly vertically through bore 46 into and then through elongated bore 44, then perpendicularly vertically through bore 42 into and then through elongated bore 40, and then outward through the outlet fitting in outlet bore 34.

It will be appreciated by those of skill in the art, that the elongated bores or passages 40, 44, 50, 54, 58, 62 may be drilled into a solid block of a structural material such as aluminum. In the currently preferred embodiment, 6061 T6 Aluminum is utilized. The vertical bores 42, 46, 56, 60, the cross bore 52, the inlet bore 38 and outlet bore 34 may then be drilled to the appropriate depth in the block to properly construct the flow labyrinth. It will further be appreciated that the labyrinth may be of any appropriate arrangement so long as the design provides the required heating properties. In the currently preferred embodiment, on the order of 15%-30% of the mass 30 is open chemical flow paths, more preferably, approximately 22% is open flow paths. Following the construction of the labyrinth arrangement, the apertures opening into the bores 42, 46, 56, 60 may be sealed with appropriately sized plugs 42*a*, 46*a*, 56*a*, 60*a*, and the inlet fitting 36 and outlet fitting 32 sealed to the inlet and outlet bores 38, 34 to complete the labyrinth. It will be appreciated that any appropriate method of sealing the same may be utilized. For example, threads may be provided as shown and an appropriate gasket, o-ring or other seal provided.

In order to increase the versatility of the mass 30, alternate inlet and outlet openings 68, 66 may be provided that open into the adjacent elongated bores 62, 40 from an alternate surface. In the illustrated embodiment, the alternate inlet and outlet bores 68, 66 are provided in what is shown as the top surface of the mass 30 as opposed to the side surfaces to provide versatility in the design of the inlet and outlet configurations. When not in use, one of each of the inlet and outlet bores 38, 68, 34, 66 may be sealed using an appropriate plug 72, 70 by any appropriate arrangement, as explained above.

In accordance with the invention, the preheater 22 is further provided with a plurality of elongated heater rods 74, 76, 78, 80, 82, 84 that are disposed directly in the elongated bores 40, 44, 50, 54, 58, 62, respectively, of the structural mass 30. A pair of wires 85 is provided to a coupling 87 for each rod to provide power to heat the rods, as will be understood by those of skill in the art. In this way, the material flowing through the labyrinth of bores flows along and around the heating elements.

Figure 4:
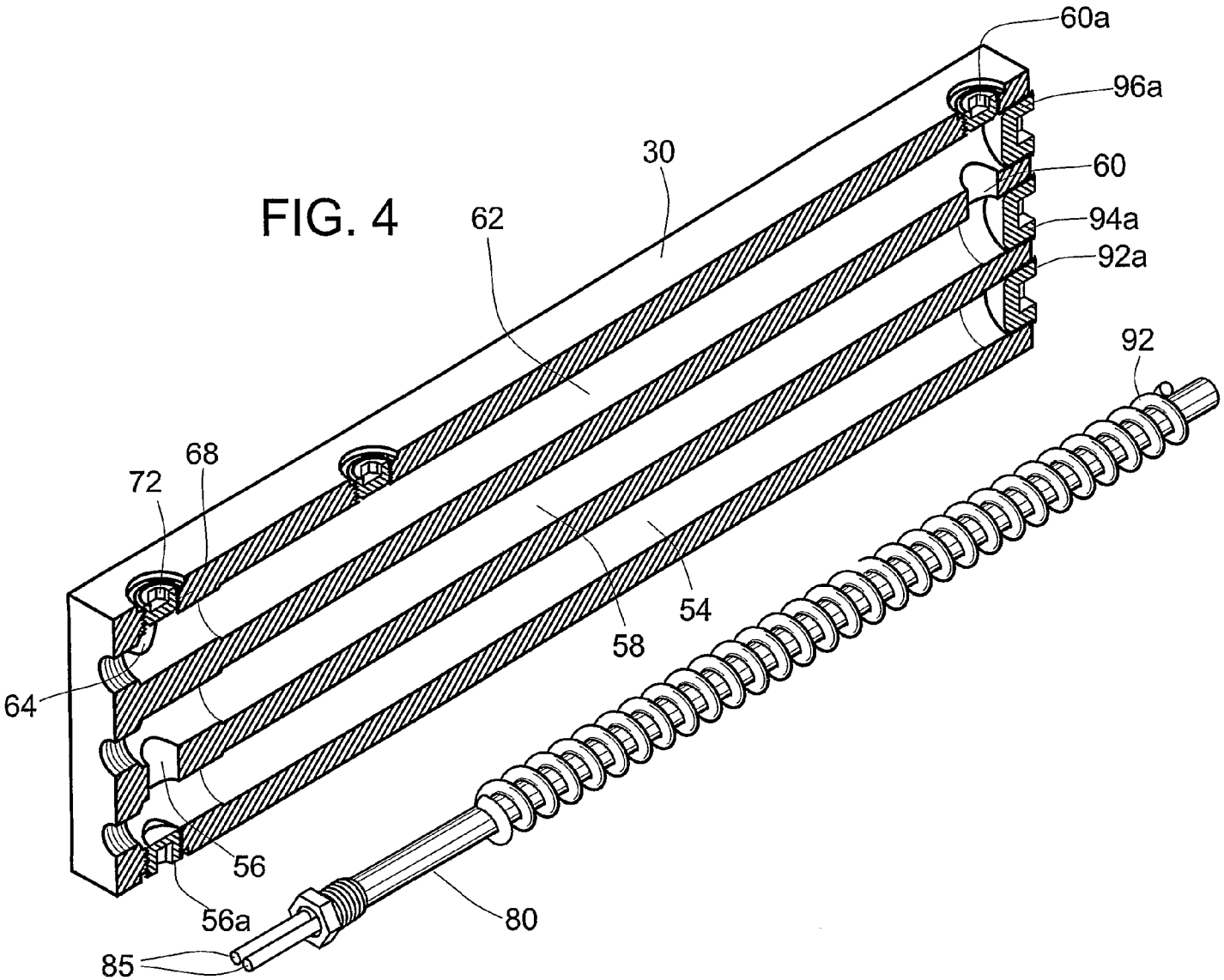
FIG. 4 is a cross-sectional view of the structural mass taken along line 4-4 in FIG. 2.
Figure 5:
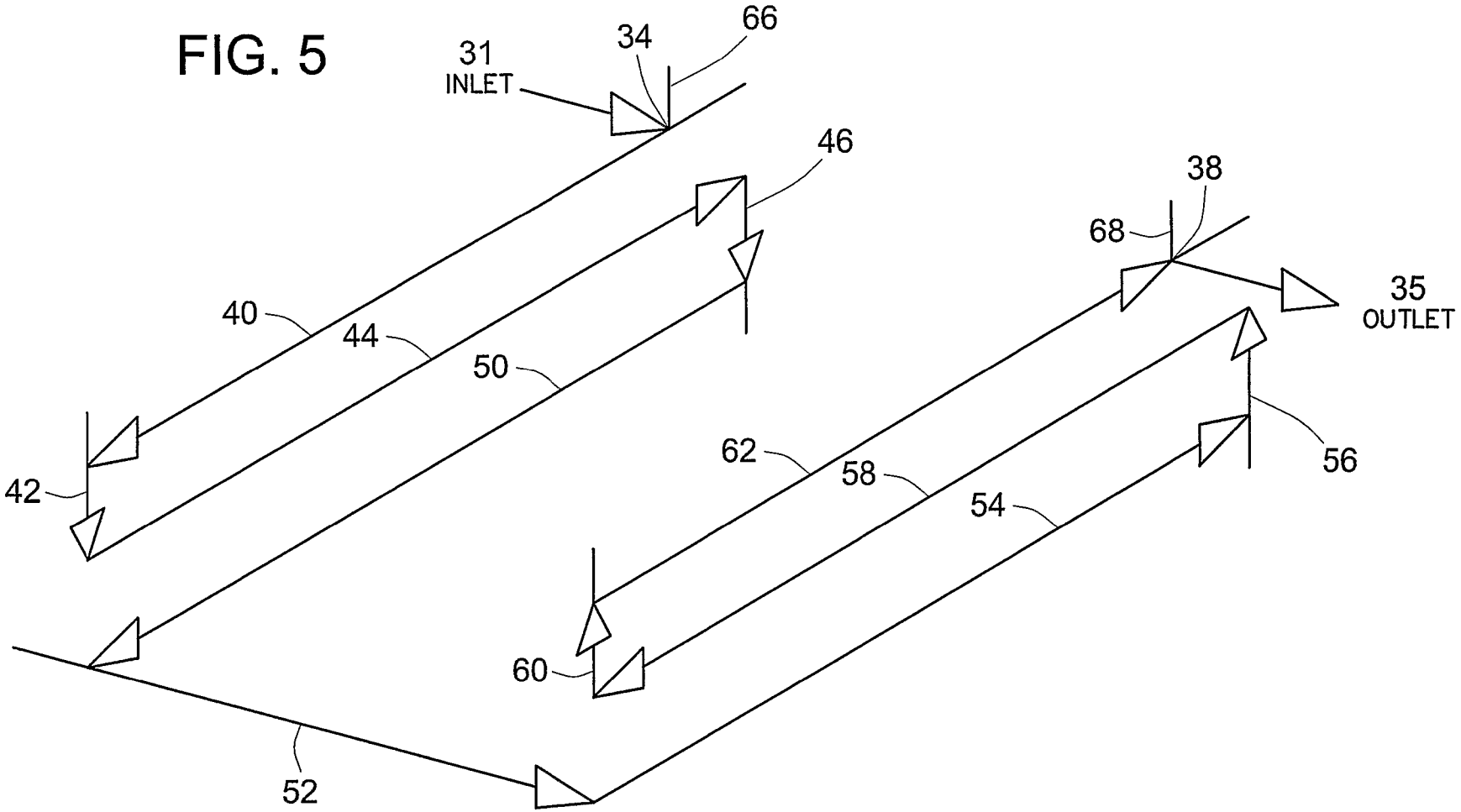
FIG. 5 is a schematic view of the material flow path through the structural mass of FIG. 2.
Figure 6:
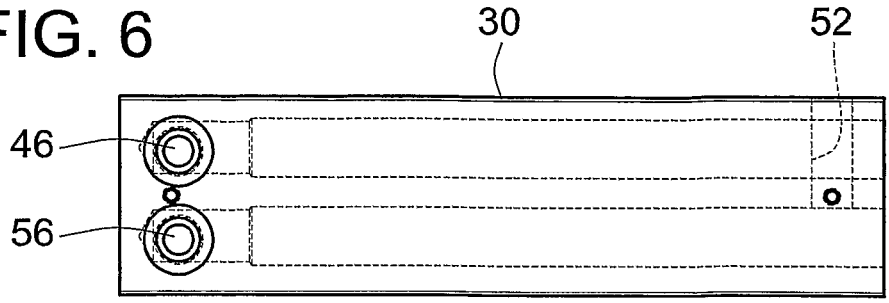
FIG. 6 is a bottom view of the structural mass of the hybrid heater of FIG. 2.
Figure 7:
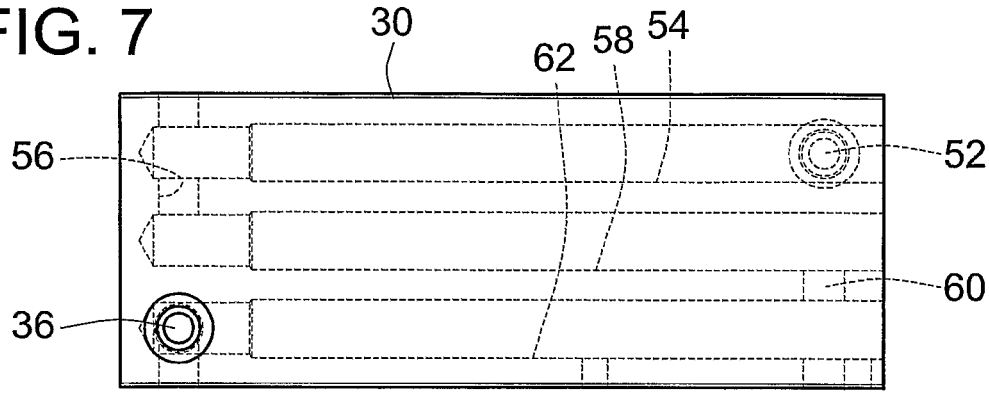
FIG. 7 is a side view of the structural mass of the hybrid heater of FIG. 2.
Figure 8:
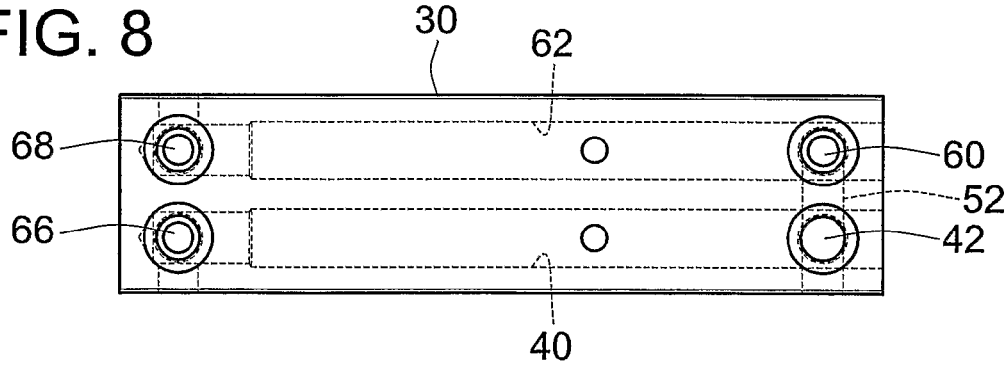
FIG. 8 is a plan view of the structural mass of the hybrid heater of FIG. 2.
Figure 9:
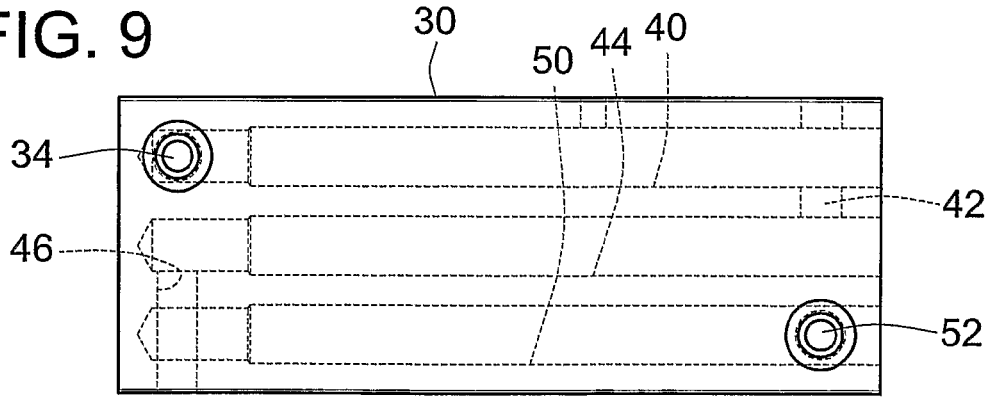
FIG. 9 is an opposite side view of the structural mass of the hybrid heater of FIG. 2.
Figure 10:
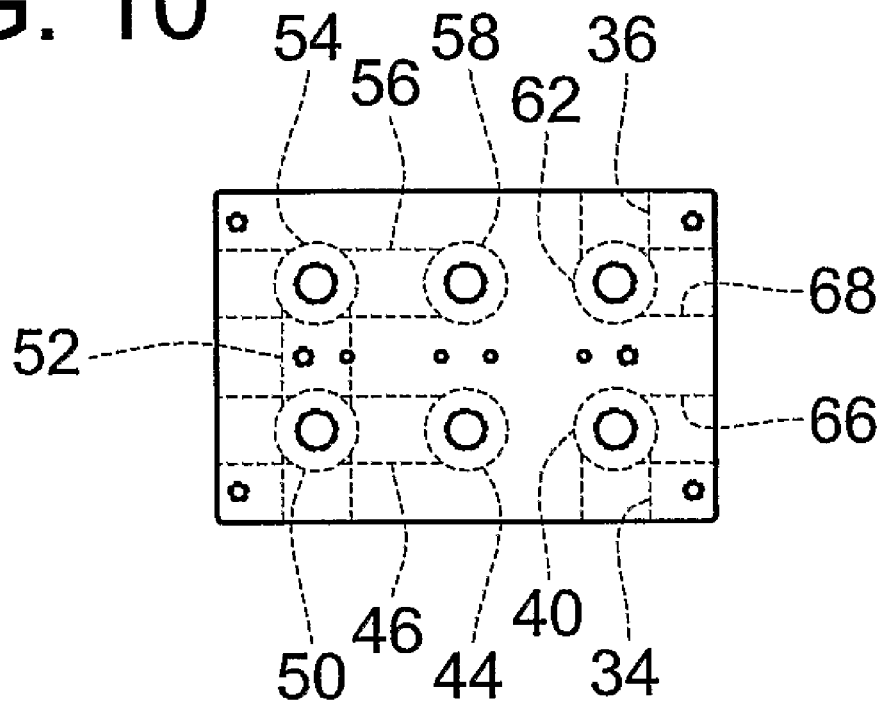
FIG. 10 is an end view of the structural mass of the hybrid heater of FIG. 2.
Figure 11:
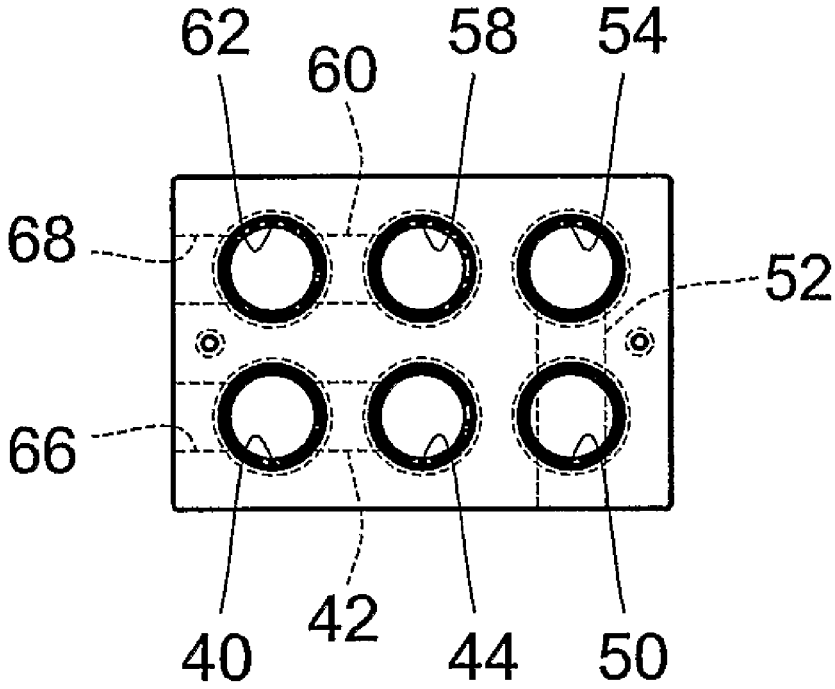
FIG. 11 is a view of the opposite end of the structural mass of the hybrid heater of FIG. 2.

In order to further enhance the uniformity of the heating, a spiral flow path may be provided along the heater rods 74, 76, 78, 80, 82, 84. This spiral flow path may be provided by any appropriate structure. In the preferred embodiment, however, the spiral flow path is provided by a coil 86, 88; 90, 92, 94, 96 that is sized such that it tightly contacts both the outer surfaces of the heater rods 74, 76, 78, 80, 82, 84 and the inner surfaces of the elongated bores 40, 44, 50, 54, 58, 62. For purposes of explanation, a single such heater rod 80 and coil 92 is shown in FIG. 4, although the remaining heater rod and coil combinations will be essentially the same. Plugs 86*a*, 88*a*, 90*a*, 92*a*, 94*a*, 96*a* are provided to seal the coils 86, 88, 90, 92, 94, 96 within the bores 40, 44, 50, 54, 58, 62. In this way, the coil 86, 88, 90, 92, 94, 96 forces the chemical material to uniformly flow between the heater rods 74, 76, 78, 80, 82, 84 and the bore 40, 44, 50, 54, 58, 62, eliminating random flow that may result in inefficient heating. As a result, the preheater 22 provides every efficient heat transfer and very low backpressure development.

Figure 2:
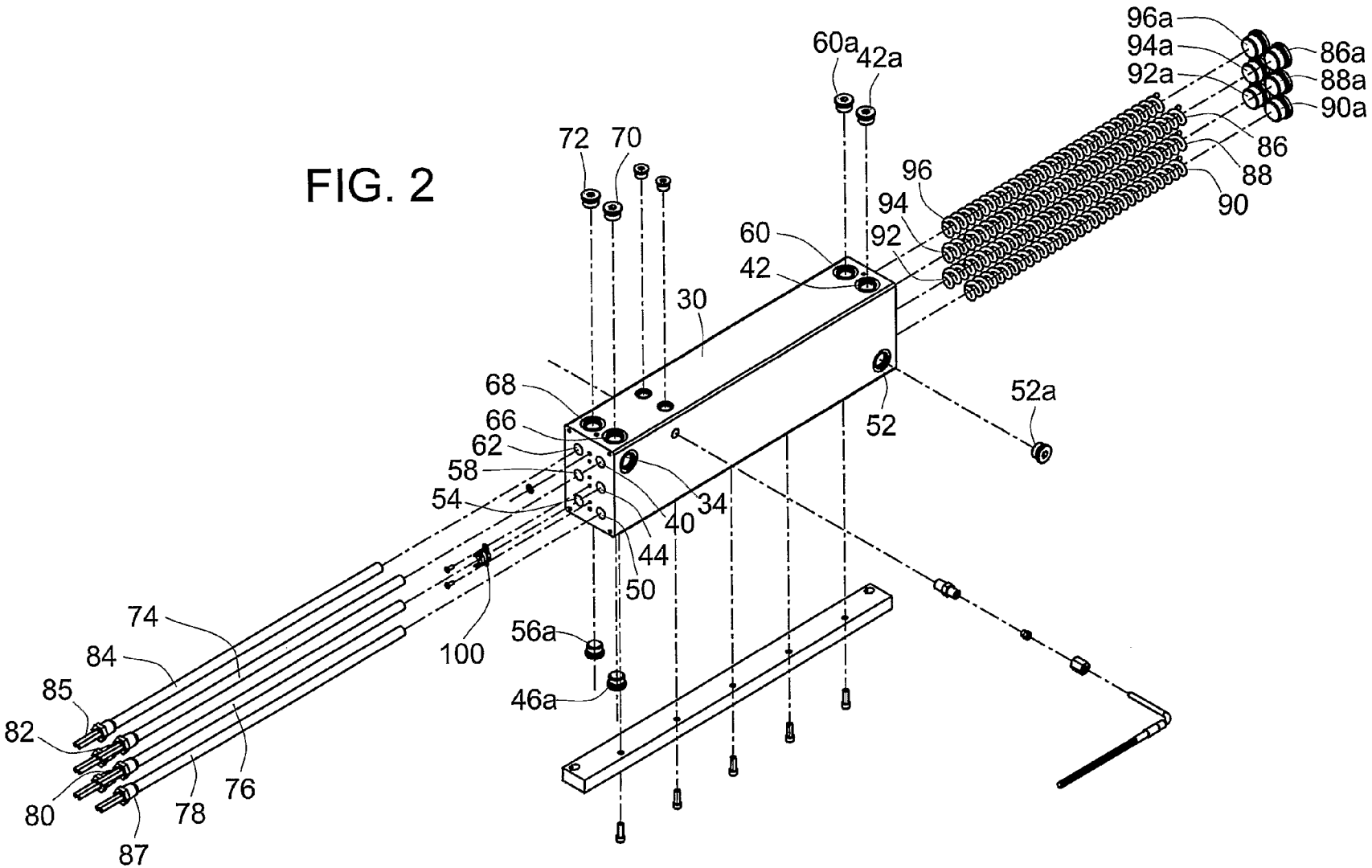
FIG. 2 is an exploded perspective view of the hybrid heater of FIG. 1.

The preheater may additionally include a temperature sensor 100 to assist in temperature control. As shown in FIG. 2, the temperature sensor 100 is disposed in direct contact with the heater rod 74, i.e. the heater rod adjacent the outlet bore 34, 66. As a result, a relatively small delta T is maintained between the surface of the element and the process temperature of the chemical material flowing through the preheater. Additionally, the temperature sensor maybe fitted with a mass sleeve, which draws off any excess heat on the sensor during transitions and results in very stable temperature control. It will be appreciated by those of skill in the art that an over-temperature disk 102 may be provided along an outside surface of the mass 30 to cut power to the heater rods should an excessive external surface temperature be reached, i.e., over 210° F.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. For example, while the invention has been described with regard to the use of six elongated bores or passages and six heater rods, an alternate number may be provided. For example, two, three, four, five, seven, eight or more such passages and/or heating rods may be provided. Additionally, an alternate labyrinth arrangement may be provided. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A hybrid heater for heating fluids, the heater comprising a structural mass comprising a plurality of elongated passages, the elongated passages having respective major axes, said elongated passages being coupled to provide an elongated heating flow path, said structural mass further comprising an inlet and an outlet fluidly coupled to the heating flow path whereby, a plurality of elongated heater rods, said rods being disposed within said elongated passages such that fluid introduced into the structural mass through the inlet flows through the elongated heating flow path and out of the structural mass through the outlet, the fluid flowing between the heater rods and the passages whereby said fluid is heated, and wherein a volume defined by the elongated heating flow path is at most 30% of a volume enclosed by a surface bounding the structural mass externally.

2. The hybrid heater of claim 1 wherein the structural mass comprises an aluminum block.

3. The hybrid heater of claim 1 wherein the structural mass comprises a plurality of drilled bores, said drilled bores forming said plurality of elongated passages and forming said elongated heating flow path.

4. The hybrid heater of claim 3 wherein the plurality of drilled bores comprises a plurality of drilled bores in a first direction and a plurality of drilled bores in a second direction, said first direction being substantially at right angles to the second direction.

5. The hybrid heater of claim 1 wherein the flow path further comprises a spiral flow path about at least one of the elongated heater rods between said heater rod and an at least one elongated passage in which said at least one of the elongated heater rods is disposed.

6. The hybrid heater of claim 5 further comprising an elongated spiral coil disposed between the at least one of the elongated heater rods and the at least one elongated passage in which said at least one of the elongated heater rods is disposed, said spiral coil, said at least one of the elongated heater rods and said at least one passage in which said at least one of the elongated heater rods is disposed forming said the spiral flow path.

7. The hybrid heater of claim 1 further comprising at least one temperature sensor.

8. The hybrid heater of claim 7 wherein said at least one temperature sensor is disposed in direct contact with at least one of said elongated heater rods.

9. The hybrid heater of claim 7 further comprising a mass sleeve, said mass sleeve being disposed about the temperature sensor.

10. A method of preheating a fluid comprising the steps of providing power to a plurality of heater rods disposed within a plurality of elongated passages formed in a structural mass, the plurality of elongated passages in the structural mass being connected to form an elongated, heating flow path, a volume defined by the elongated heating flow path being at most 30% of a volume enclosed by a surface bounding the structural mass externally, introducing the fluid into a structural block through an inlet into the flow path, passing the fluid between a plurality of heater rods and the inside walls of the plurality of elongated passages to heat said fluid.

11. The method of claim 10 wherein the passing step comprises the step of passing the fluid along a spiral path between the plurality of heater rods and the inside walls of the plurality of elongated passages.

12. The method of claim 11 further comprising the step of forming a spiral path between the plurality of heater rods and the inside walls of the plurality of elongated passages.

13. The method of claim 12 wherein the forming step comprises the step of disposing at least one spiral coil about the circumference of at least one of the heater rods such that the coil is in contact with both the heater rod and the passage in which it is disposed.

14. The method of claim 10 further comprising the step of forming said structural mass from a block of material by drilling a plurality of bores to form the plurality of elongated passages.

15. The method of claim 10 further comprising the step of forming the structural mass from a structural block by drilling a plurality of bores in a first direction to form the plurality of elongated passages, and drilling a plurality of bores in a second direction to connect the plurality of elongated passages to form the elongated heating flow path.

16. The method of claim 10 further comprising the step of monitoring the temperature of at least one of the fluid flowing through the flow path or at least one of the heater rods.

17. The method of claim 16 wherein the monitoring step comprises the step of providing a temperature sensor, and further comprising the step of fitting the temperature sensor with a mass sleeve.

18. The hybrid heater of claim 1 wherein the volume defined by the elongated heating flow path is at most 22% of a volume enclosed by the surface bounding the structural mass externally.

19. The hybrid heater of claim 1 wherein the structural mass is formed from a rectangular prismatic block having an initial volume in which the elongated heating flow path is formed by a plurality of bores drilled to remove a volume which is at most 22% of the initial volume.

20. The hybrid heater of claim 1 wherein the volume defined by the elongated heating flow path is at least 15% of the volume enclosed by the surface bounding the structural mass externally.

21. The method of claim 10 wherein the volume defined by the elongated heating flow path is at least 15% of the volume enclosed by the surface bounding the structural mass externally.

22. The method of claim 10 wherein the volume defined by the elongated heating flow path is at most 22% of a volume enclosed by the surface bounding the structural mass externally.

* * * * *